US006776336B2

(12) United States Patent
Bowen

(10) Patent No.: US 6,776,336 B2
(45) Date of Patent: Aug. 17, 2004

(54) BALLISTICS FIRE CONTROL SOLUTION PROCESS AND APPARATUS FOR A SPIN OR FIN STABILIZED PROJECTILE

(75) Inventor: Peter John Bowen, Ivybridge (GB)

(73) Assignee: BAE Systems plc, London (GB)

( * ) Notice: Subject to any disclaimer, the term of this patent is extended or adjusted under 35 U.S.C. 154(b) by 56 days.

(21) Appl. No.: 10/220,804

(22) PCT Filed: Feb. 20, 2001

(86) PCT No.: PCT/GB01/00708

§ 371 (c)(1),
(2), (4) Date: Dec. 17, 2002

(87) PCT Pub. No.: WO01/67025

PCT Pub. Date: Sep. 13, 2001

(65) Prior Publication Data

US 2003/0141364 A1 Jul. 31, 2003

(30) Foreign Application Priority Data

Mar. 9, 2000 (GB) ..... 0005594

(51) Int. Cl.[7] ..... G06F 19/00
(52) U.S. Cl. ..... 235/412
(58) Field of Search ..... 235/411–413

(56) References Cited

U.S. PATENT DOCUMENTS 3,230,348 A * 1/1966 Hammond, Jr. ..... 235/400
3,737,902 A * 6/1973 O'Hagan et al. ..... 342/41
4,057,708 A * 11/1977 Greeley et al. ..... 235/413
4,124,849 A 11/1978 Zahornasky et al. ..... 343/7
4,128,837 A * 12/1978 Page ..... 342/67
4,146,780 A * 3/1979 Sprey ..... 235/412
4,148,026 A * 4/1979 Gendreu ..... 342/80
4,312,262 A * 1/1982 Tye ..... 89/41.21
4,672,381 A 6/1987 Labbe et al. ..... 342/99
5,140,329 A 8/1992 Maughan et al. ..... 342/67
5,164,910 A * 11/1992 Lawson et al. ..... 235/411
5,644,099 A 7/1997 Rabbow et al. ..... 102/214

FOREIGN PATENT DOCUMENTS

| | | |
|---|---|---|
| FR | 2 577 036 | 1/1985 |
| GB | 2 33 691 A | 10/1979 |
| GB | 2 127 944 | 9/1983 |

* cited by examiner

*Primary Examiner*—Mark Tremblay
(74) *Attorney, Agent, or Firm*—Crowell & Moring LLP

(57) ABSTRACT

A ballistics fire control system for a spin or fin stabilized projectile is provided with means which are operated such that the closest point of approach between a fired projectile and a target is taken to be at the instant the projectile velocity vector (6) is orthogonal to the position error vector (13) between the projectile and target in accordance with the relationship: $V_P \cdot (P_P - P_F) = 0$ where $V_P$ is the projectile velocity vector, $P_P$ is the projectile trajectory or position vector, $P_F$ is the target future position vector, • is the vector dot product and $(P_P - P_F)$ is the position error vector.

9 Claims, 2 Drawing Sheets

BALLISTICS FIRE CONTROL SOLUTION PROCESS AND APPARATUS FOR A SPIN OR FIN STABILIZED PROJECTILE

BACKGROUND OF THE INVENTION

This invention relates to a ballistics fire control solution process and apparatus for a spin or fin stabilised projectile particularly, but not exclusively, suitable for use with guns.

The trajectory of spin stabilised projectiles, such as rounds fired from conventional rifled gun barrels, or of fin stabilised projectiles, such as missiles fired from launchers, through the atmosphere conventionally is predictable by a process involving determining the trajectory of the projectile in three dimensional space as a function of time in flight, deriving the acceleration components acting on the projectile and using this data in fundamental equations of motion to derive the predicted trajectory. During Range and Accuracy firings of a projectile such as a gun round on a calibrated range, the ballistics and aerodynamic input parameters are tuned such that the trajectory predicted accurately matches independent, for example radar, measurements of the trajectory. This results in a so called calibrated trajectory for a particular round/fuse combination. This is a relatively time consuming process and cannot be carried out fast enough to enable a gun Fire Control Solution (FCS) to be achieved at a fast enough rate for use by a real-time FCS computer such as a GSA8. Hence the calibrated trajectory has been used to produce Designer Extended Range Tables from which the projectile launcher (such as a gun) azimuth and elevation orders could be determined for a given situation. A process of Range Table Reduction then has to be invoked where various two dimensional cubic-spline curve fitting to the Designer Range Tables has to be performed. The coefficients generated from the Range Table Reduction (curve-fitting) process then require to be implemented in a real time fire control solution computer.

A disadvantage of such conventional Range Table Reduction processes is that further approximations are introduced into the FCS and thus the computed gun orders in the real time FCS diverge from the values that would have been derived using the more accurate calibrated trajectories.

There is thus a need for a process and apparatus which can utilise calibrated trajectories for projectiles in a real time projectile Fire Control process.

SUMMARY OF THE INVENTION

According to one aspect of the present invention there is provided a ballistics fire control process for a spin or fin stabilised projectile, in which the closest point of approach between a fired projectile and a target is taken to be at the instant when the projectile velocity vector is orthogonal to the position error vector between the projectile and target, in accordance with the relationship:

$$V_p \bullet (P_p - P_F) = 0$$

where $V_p$ is the projectile velocity vector, $P_p$ is the projectile trajectory or position vector, $P_F$ is the target future position vector, • is the vector dot product and $(P_p - P_F)$ is the position error vector.

According to another aspect of the present invention there is provided a ballistics fire control process for a spin or fin stabilised projectile, including the steps of:

(a) tracking a target, (b) producing a target position vector and a target velocity vector for the tracked target, (c) producing a calibrated trajectory vector, a calibrated velocity vector and a time in flight value for the projectile, at current projectile launcher azimuth and elevation values, (d) calculating the target future position vector from the target position vector, target velocity vector and projectile time in flight value, (e) firing the projectile, (f) calculating the achieved closest point of approach of the projectile to the target from the projectile calibrated trajectory vector, projectile calibrated velocity vector and target future position vector, (g) comparing the achieved closest point of approach of the projectile to a desired zero value to produce an error value, (h) integrating the achieved closest point of approach error value, (j) calculating corrected projectile launcher azimuth and elevation values from the integrated achieved closest point of approach error value to drive the achieved closest point of approach towards zero and (k) repeating steps (a) to (j) if necessary to produce a substantially zero achieved closest point of approach value of the projectile and target.

Preferably at the closest achieved point of approach the projectile velocity vector is orthogonal to the position error vector between the projectile and target in accordance with the relationship:

$$V_P \bullet (P_p - P_F) = 0$$

where $V_p$ is the projectile velocity vector, $P_P$ is the projectile trajectory or position vector, $P_F$ is the target future position vector, • is the vector dot product and $(P_P - P_F)$ is the position error vector.

Conveniently the target future position vector is generated over the same simulated time-frame in which the projectile trajectory vector is generated and the target future position vector and projectile calibrated trajectory vector are differenced as a function of time to provide the achieved closest point of approach between the fired projectile and target.

Advantageously, the achieved closest point of approach is driven towards zero in steady state conditions.

According to a further aspect of the present invention there is provided a ballistics fire control systems for a spin or fin stabilised projectile including, a target tracker for generating a target position vector and a target velocity vector, means for generating a calibrated trajectory vector, a calibrated velocity vector and a time in flight value for the projectile at current projectile launcher azimuth and elevation values, a target future position predictor for receiving from the generating means the projectile time in flight value and from the target tracker the target position vector and the target velocity vector and for calculating the target future position vector from the target position vector, target velocity vector and projectile time in flight, a closest position of approach computer for receiving the target future position vector from the target future position predictor and the projectile calibrated trajectory vector and projectile calibrated velocity vector from the generator means and for calculating therefrom the achieved closest point of approach of the projectile to the target, a comparator for receiving from the closest position of approach computer the achieved closest point of approach of the projectile and for comparing it to a desired zero value to produce an error value, an integrator for receiving and integrating the error value from the comparator, and a compensator for calculating corrected projectile launcher azimuth and elevation values from the integrated achieved closest point of approach error value to drive the achieved closest point of approach error value towards zero.

Preferably the target tracker is a radar unit or is an electro-optical unit.

Conveniently the compensator is operatively connectable to a servo mechanism forming part of a laying mechanism for the projectile launcher.

According to yet another aspect of the present invention there is provided a ballistics fire control systems according to the present invention in combination with a projectile launcher in the form of a gun.

For a better understanding of the present invention, and to show how the same may be carried into effect, reference will now be made, by way of example, to the accompanying drawings, in which:

DETAILED DESCRIPTION OF THE INVENTION

Figure 1:
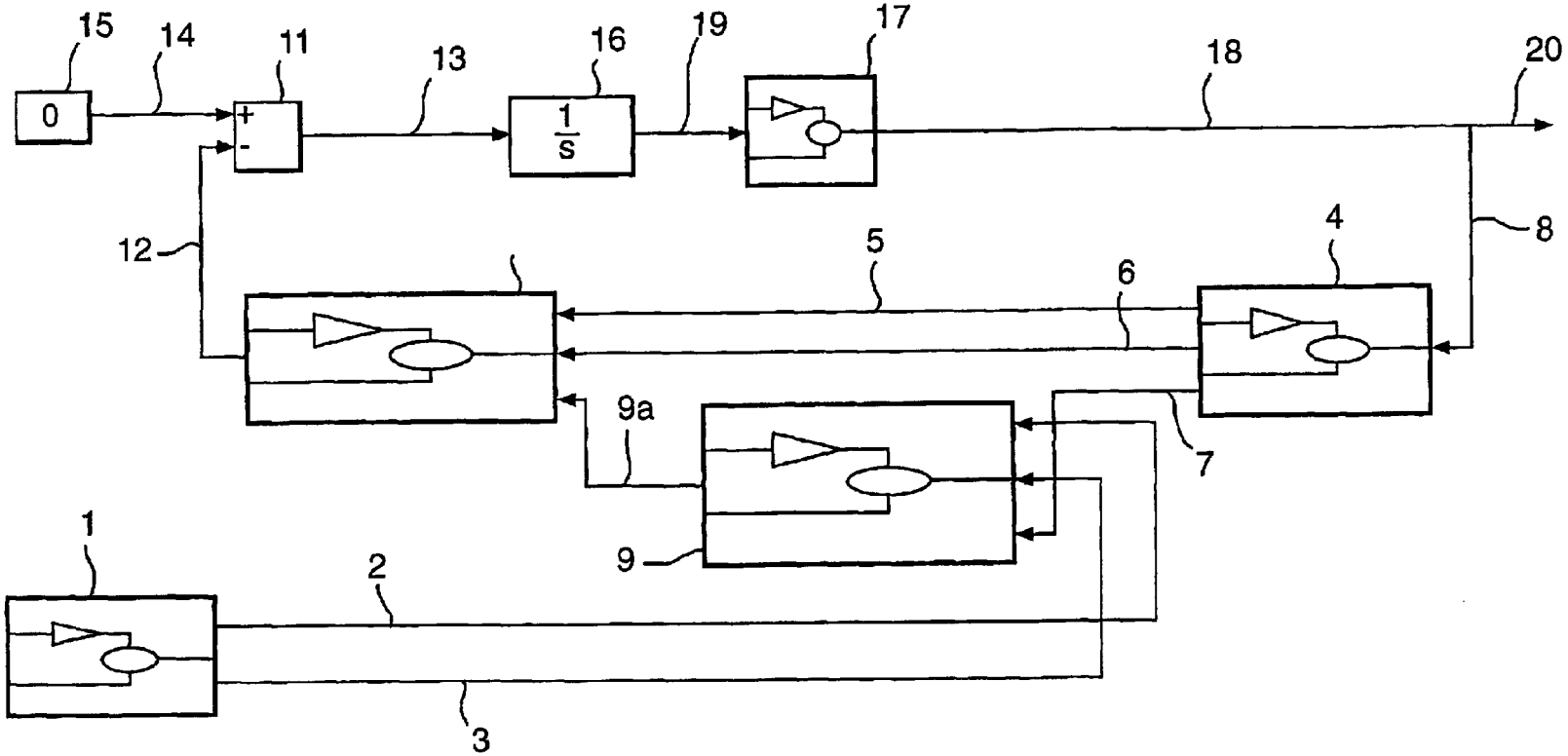
FIG. 1 is a diagrammatic view of a ballistics fire control system for a spin or fin stabilised projectile according to a first embodiment of the present invention.

A ballistics fire control process according to the present invention uses a ballistics fire control system of the present invention as illustrated in FIG. 1 of the accompanying drawings. The process and system are suitable for use with any type of spin or fin stabilised projectile of the fire and forget variety such as an unguided missile fired from a projectile launcher or an explosively propelled round fired from a conventional rifled barrel of a gun. In the process of the invention the closest point of approach between a fired projectile and a target is taken to be at the instant the projectile velocity vector is orthogonal to the position error vector between the projectile and target in accordance with the relationship, $$V_p \bullet (P_p - P_F) = 0 \quad (1)$$

where $V_p$ is the projectile velocity vector, $P_p$ is the projectile trajectory or position vector, $P_F$ is the target future position vector, • is the vector dot product and $(P_P - P_F)$ is the position error vector.

With reference to FIG. 1, the system of the invention incorporates a target tracker 1, which may be a radar unit or an electro-optical unit, for generating a target position vector 2 and a target velocity vector 3. Means 4 are provided for generating a calibrated trajectory vector 5, a calibrated velocity vector 6 and a time in flight value 7 for the projectile at current projectile launcher azimuth and elevation values received via line 8. The systems incorporates a target future position predictor 9 for receiving from the means 4 the projectile time in flight value 7 and from the target tracker 1 the target position vector 2 and the target velocity vector 3 and for calculating the target future position vector 9*a* from the target position vector 2, target velocity vector 3 and projectile time in flight value 7. There is a closest position of approach computer 10 for receiving the target future position vector 9*a* from the predictor 9 and the projectile calibrated trajectory vector 5 and projectile calibrated velocity vector 6 from the generator means 4 and for calculating therefrom the achieved closest point of approach of the projectile to the target.

A comparator 11 receives from the closest position of approach computer 10 the achieved closest position of approach 12 of the projectile to the target and compares it to a desired zero value to produce an error value 13. The desired zero value signal 14 is received from a closest point of approach demand unit 15.

Also forming part of the system of the present invention is an integrator 16 for receiving and integrating the error value 13 from the comparator 11 and a compensator 17 for calculating corrected projectile launcher azimuth and elevation values 18 from the integrated achieved closest point of approach error value 19 to drive the achieved closest point of approach value 12 towards zero. The compensator 17 is operatively connectable to a servo mechanism forming part of a laying mechanism for the projectile launcher, as at 20.

The system of the present invention as shown in FIG. 1 is operated to drive the achieved closest point of approach value 12 towards zero and to maintain it at zero. To this end the ballistics fire control process of the invention includes the steps of tracking a target with the tracker 1, producing a target position vector 2 and a target velocity vector 3 for the tracked target and producing a calibrated trajectory vector 5, a calibrated velocity vector 6 and a time in flight value 7 for the projectile at current projectile launcher azimuth and elevational values. The target future position vector 9*a* is calculated from the target position vector 2, target velocity vector 3 and projectile time in flight value 7 and the projectile is fired. Then the achieved closest point of approach 12 of the projectile to the target is calculated from the projectile calibrated trajectory vector 5, projectile calibrated velocity vector 6 and target future position vector 9*a*.

Subsequently the achieved closest point of approach 12 of the projectile 2 is compared to a desired zero value 14 to produce an error value 13 which is integrated. Corrected projectile launcher azimuth and elevation values 18 are calculated from the integrated achieved closest point of approach error value 19 to drive the achieved closest point of approach towards zero. These steps may be repeated if necessary to produce a substantially zero achieved closest point of approach value of the projectile and target.

The target future position vector 9*a* is generated over the same simulated time-frame in which the projectile trajectory vector 5 is generated and the target future position vector 9*a* and projectile calibrated trajectory vector 5 are differenced as a function of time to provide the achieved closest point of approach 12 between the fired projectile and target. The achieved closest point of approach value 12 is driven towards zero in steady state conditions.

With the process of the present invention as used for the system of the present invention if the achieved closest point of approach value 12 is non-zero, the integrator 16 and compensator 17 modify the projectile launcher azimuth and elevation orders accordingly in order to reduce it the achieved closest point of approach value 12. The generating means 4 is then run again for the particular projectile or gun round for which it is calibrated with the updated projectile launcher orders in parallel with the target future position predictor 9. The computer 10 then determines when the projectile trajectory locus computed by the generating means 4 reaches the closest point of approach to the target future position predictor 9. At this point the trajectory and future position computations are halted. The magnitude of the new closest point of approach value 12 is fed into the integrator 16 and compensator 17 to generate updated projectile launcher orders for the next cycle of the loop. The loop runs synchronously at a rate appropriate to the dynamics of the target to be engaged.

The generating means 4 is variable to enable calibrated standard trajectory vectors and velocity vectors to be generated for a specific projectile such as a specific ammunition round. The target future position predictor 9 generates the locus of target future position over the same simulated time-frame as the trajectory locus provided by the generating means 4. The computer 10 differences the two loci as a function of time to compute the closest distance of approach of the projectile to the target. The compensator 17 contains a shaping filter which governs the servo loop dynamics and stability.

The formula $$V_p \cdot (P_p - P_F) = 0 \quad (1)$$

effectively states that at the closest point of approach the projectile velocity vector 6 will be orthogonal to the position error vector 13 since at this specific instant the projectile is neither approaching nor receding from the target. When the trajectory is relatively flat for the shorter ranges, the above condition will occur when the projectile is directly over (or under) the target. When the trajectory is distinctly parabolic at longer ranges the above condition will occur when the projectile is above and beyond the target or below and short of the target by an increment of range and height with the relative contributions of the range increment and height increment to the position error vector being a function of the angle of descent of the projectile. The elevation servo loop 18 drives the position error vector to zero. Linear interpolation may be used to find the exact point in time for which the above condition is satisfied.

Figure 2:
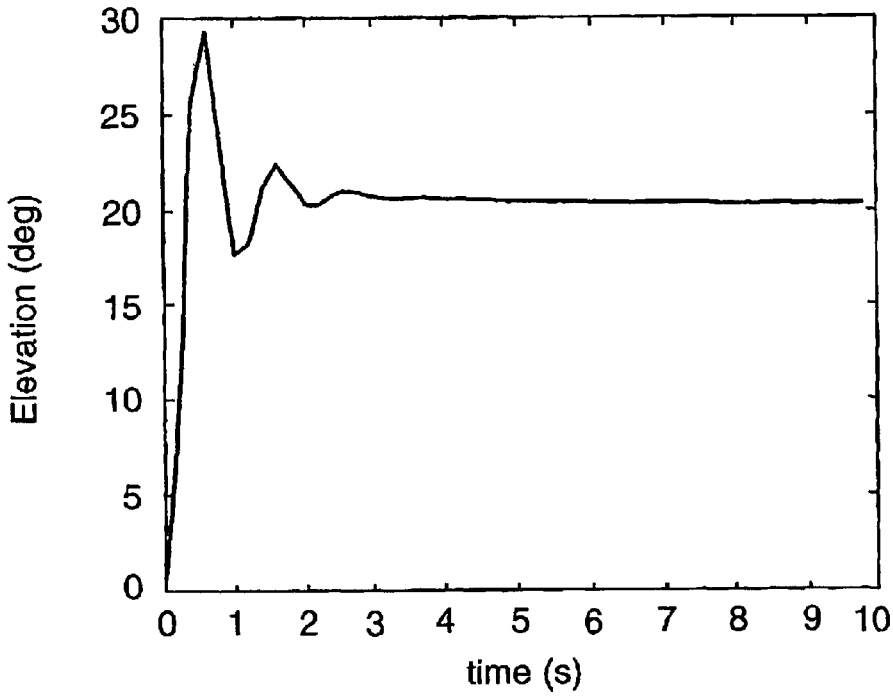
FIG. 2 is a graphical representation of projectile launcher elevation with time for a ballistics fire control process according to the present invention running synchronously at a 5 Hz rate.
Figure 3:
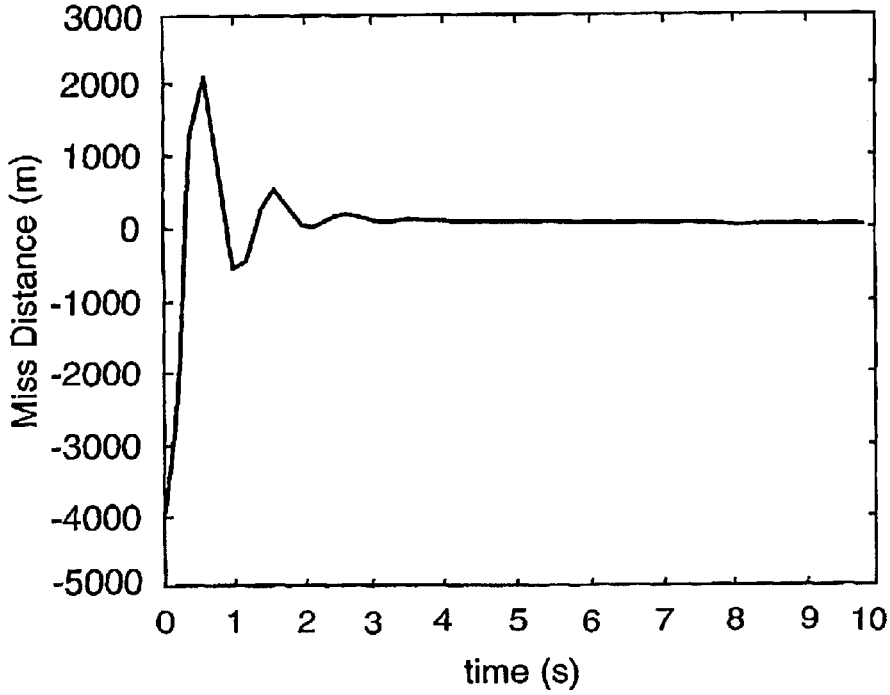
FIG. 3 is a graphical representation for the same ballistics fire control system as FIG. 2 of the closest point of approach showing the miss distance plotted with time.

FIGS. 2 and 3 illustrate the results achieved by using a ballistics fire control system according to the present invention to achieve a fire control solution in real time in a GSA8 computer for a projectile in the form of extended range ammunition. The results as shown in FIGS. 2 and 3 are for a fire control solution running synchronously at a 5 Hz rate. It can be seen from FIGS. 2 and 3 that in a time of less than two second it was possible to achieve a zero error deviation for the achieved closest point of approach between the projectile and target to achieve a hit.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A ballistics fire control process for a spin or fin stabilised projectile, in which the closest point of approach between a fired projectile and a target is taken to be at the instant when the projectile velocity vector is orthogonal to the position error vector between the projectile and the target, in accordance with the relationship:

$$V_p \cdot (P_p - P_F) = 0$$

where $V_p$ is the projectile velocity vector, $P_p$ is the projectile trajectory or position vector, $P_F$ is the target future position vector, • is the vector dot product and $(P_p - P_F)$ is the position error vector.

2. A ballistics fire control process for a spin or fin stabilised projectile, including the steps of:

(a) tracking a target, (b) producing a target position vector and a target velocity vector for the tracked target, (c) producing a calibrated trajectory vector, a calibrated velocity vector and a time in flight value for the projectile, at current projectile launcher azimuth and elevational values, (d) calculating the target future position vector from the target position vector, target velocity vector and projectile time in flight value, (e) firing the projectile, (f) calculating the achieved closest point of approach of the projectile to the target from the projectile calibrated trajectory vector, projectile calibrated velocity vector and target future position vector, (g) comparing the achieved closest point of approach of the projectile to a desired zero value to produce an error value, (h) integrating the achieved closest point of approach error value, (j) calculating corrected projectile launcher azimuth and elevation values from the integrated achieved closest point of approach error value to drive the achieved closest point of approach towards zero, and (k) repeating steps (a) to (j) if necessary to produce a substantially zero achieved closest point of approach value of the projectile and target.

3. A process according to claim 2, in which at the closest achieved point of approach the projectile velocity vector is orthogonal to the position error vector between the projectile and target, in accordance with the relationship:

$$V_p \cdot (P_p - P_F) = 0$$

where $V_p$ is the projectile velocity vector, $P_p$ is the projectile trajectory or position vector, $P_F$ is the target future position vector, • is the vector dot product and $(P_p - P_F)$ is the position error vector.

4. A process according to claim 2, in which the target future position vector is generated over the same simulated time-frame in which the projectile calibrated trajectory vector is generated and in which the target future position vector and projectile calibrated trajectory vector are differenced as a function of time to provide the achieved closest point of approach between the fired projectile and target.

5. A process according to claim 2, in which the achieved closest point of approach is driven towards zero in steady state conditions.

6. A ballistics fire control system for a spin or fin stabilised projectile including, a target tracker for generating a target position vector and a target velocity vector, means for generating a calibrated trajectory vector, a calibrated velocity vector and a time in flight value for the projectile, at current projectile launcher azimuth and elevation values, a target future position predictor for receiving from the generating means the projectile time in flight value and from the target tracker the target position vector and the target velocity vector, and for calculating the target future position vector from the target position vector, target velocity vector and projectile time in flight, a closest position of approach computer for receiving the target future position vector from the target future position predictor and the projectile calibrated trajectory vector and projectile calibrated velocity vector from the generating means and for calculating therefrom the achieved closest point of approach of the projectile to the target, a comparator for receiving from the closest position of approach computer the achieved closed point of approach of the projectile and for comparing it to the desired zero value to produce an error value, an integrator for receiving and integrating the error value from the comparator, and a compensator for calculating corrected projectile launcher azimuth and elevation values from the integrated achieved closest point of approach error value to drive the achieved closest point of approach value towards zero.

7. A system according to claim 6, wherein the target tracker is a radar unit or is an electro-optical unit.

8. A system according to claim 6, wherein the compensator is operatively connectable to a servo mechanism forming part of a laying mechanism for the projectile launcher.

9. A ballistics fire control system according to claim 6, in combination with a projectile launcher in the form of a gun.

* * * * *